US011148859B2

(12) United States Patent
Moghaddam et al.

(10) Patent No.: US 11,148,859 B2
(45) Date of Patent: Oct. 19, 2021

(54) SAFETY CAP

(71) Applicant: Pascal Holdings, LLC, Corona Del Mar, CA (US)

(72) Inventors: Mehran M. Moghaddam, Corona Del Mar, CA (US); Manuel Alberto Alvarez, Corona Del Mar, CA (US)

(73) Assignee: Pascal Holdings, LLC, Corona Del Mar, CA (US)

( * ) Notice: Subject to any disclaimer, the term of this patent is extended or adjusted under 35 U.S.C. 154(b) by 224 days.

(21) Appl. No.: 16/568,162

(22) Filed: Sep. 11, 2019

(65) Prior Publication Data

US 2020/0010252 A1 Jan. 9, 2020

Related U.S. Application Data

(62) Division of application No. 16/027,210, filed on Jul. 3, 2018, now Pat. No. 10,414,561.

(51) Int. Cl.
*B65D 50/04* (2006.01)

(52) U.S. Cl.
CPC ..... *B65D 50/041* (2013.01)

(58) Field of Classification Search
CPC ..... B65D 50/41; A45D 40/12; A45D 40/06; A45D 40/065
USPC ..... 215/220, 201, 301
See application file for complete search history.

(56) References Cited

U.S. PATENT DOCUMENTS 3,650,426 A 3/1972 Miller
3,722,727 A 3/1973 Gach
3,764,033 A 10/1973 Smith et al.
3,797,688 A 3/1974 Porcelli et al.
4,364,484 A 12/1982 Kinsley
4,394,916 A 7/1983 Smalley
4,410,098 A 10/1983 Dubs et al.
4,433,789 A 2/1984 Gibilisco
4,609,114 A 9/1986 Roy
4,673,095 A 6/1987 Puresevic et al.
4,723,685 A 2/1988 Fillmore et al.
4,854,459 A 8/1989 DeJonge
4,957,210 A 9/1990 Kusz
4,997,096 A 3/1991 Kusz
5,009,338 A 4/1991 Barker
5,020,681 A 6/1991 Kusz
5,261,548 A 11/1993 Barker et al.
5,280,842 A 1/1994 Koo
5,316,161 A * 5/1994 Gargione ..... B65D 50/041 215/220
5,370,251 A 12/1994 Buono
5,433,329 A 7/1995 Weinstein
5,445,283 A 8/1995 Krautkramer
5,551,582 A 9/1996 Robinson
5,579,934 A 12/1996 Buono
(Continued)

OTHER PUBLICATIONS

Search Report and Written Opinion dated Sep. 12, 2019, issued in corresponding Application No. PCT/US2019/040404 (15 pages).

*Primary Examiner* — Ernesto A Grano
(74) *Attorney, Agent, or Firm* — Knobbe Martens Olson & Bear, LLP

(57) ABSTRACT

Multi-piece child resistant safety caps for containers are disclosed. A feature of the safety caps is to provide releasable securement to a container. In some embodiments, the safety cap includes a casing with at least one downwardly projecting fin and an insert with at least one upwardly projecting protrusion.

20 Claims, 11 Drawing Sheets

(56) References Cited

U.S. PATENT DOCUMENTS

| | | | |
|---|---|---|---|
| 5,588,545 | A | 12/1996 | King |
| 5,590,799 | A | 1/1997 | King |
| 5,638,970 | A | 6/1997 | Garby et al. |
| 5,676,268 | A | 10/1997 | King |
| 5,732,836 | A | 3/1998 | Barker et al. |
| 5,743,419 | A | 4/1998 | King |
| 5,765,706 | A | 6/1998 | Barker et al. |
| 5,769,252 | A | 6/1998 | Volpe |
| 5,803,283 | A | 9/1998 | Barker et al. |
| 5,819,968 | A | 10/1998 | Jones |
| 5,927,528 | A | 7/1999 | Jones |
| 5,934,492 | A | 8/1999 | Jones |
| 5,967,350 | A | 10/1999 | Jones |
| 6,085,920 | A | 7/2000 | Moretti |
| 6,095,353 | A | 8/2000 | Gargiulo et al. |
| 6,206,216 | B1 | 3/2001 | Stalions |
| 6,802,427 | B2 | 10/2004 | Miceli et al. |
| 7,000,789 | B2 | 2/2006 | Miceli et al. |
| 7,111,746 | B2 | 9/2006 | Miceli et al. |
| 7,124,904 | B1 | 10/2006 | Miceli et al. |
| 7,571,825 | B2 | 8/2009 | Takahashi |
| 7,815,061 | B1 | 10/2010 | Robinson et al. |
| 7,988,003 | B1 | 8/2011 | Clodfelter |
| 8,056,742 | B2 | 11/2011 | Brozell et al. |
| 8,109,396 | B1 | 2/2012 | Robinson et al. |
| 8,141,729 | B2 | 3/2012 | Scarlata |
| 8,157,115 | B2 | 4/2012 | Rho |
| 8,186,526 | B2 | 5/2012 | Branson et al. |
| 8,205,761 | B2 | 6/2012 | Stull, Sr. et al. |
| 8,235,616 | B2 | 8/2012 | Raccah |
| 8,474,634 | B1 | 7/2013 | Branson et al. |
| 8,534,476 | B2 | 9/2013 | Brozell |
| 8,833,577 | B2 * | 9/2014 | Habibi-Naini ..... B65D 50/045 215/200 |
| 9,126,728 | B1 | 9/2015 | Elston |
| 9,254,947 | B2 | 2/2016 | Tada et al. |
| 9,527,637 | B2 | 12/2016 | Habibi-Naini |
| 9,580,213 | B2 | 2/2017 | Dong et al. |
| 9,586,738 | B2 | 3/2017 | Herrbach et al. |
| 9,840,353 | B2 | 12/2017 | Dong et al. |
| 9,902,535 | B2 | 2/2018 | Faragher |
| 10,813,432 | B1 * | 10/2020 | Zhang ..... A45D 40/12 |
| 2002/0027119 | A1 | 3/2002 | Miceli et al. |
| 2002/0195460 | A1 | 12/2002 | Kapsa et al. |
| 2004/0045923 | A1 | 3/2004 | Lancesseur et al. |
| 2004/0045926 | A1 | 3/2004 | Williamson |
| 2004/0099627 | A1 | 5/2004 | Yan |
| 2004/0262251 | A1 | 12/2004 | Tauber |
| 2007/0144997 | A1 | 6/2007 | Hickey |
| 2007/0199912 | A1 | 8/2007 | Libohova et al. |
| 2007/0289934 | A1 | 12/2007 | Gancia |
| 2009/0014404 | A1 | 1/2009 | Russell |
| 2010/0126996 | A1 | 5/2010 | Ferri et al. |
| 2010/0237072 | A1 | 9/2010 | Ahn |
| 2011/0142526 | A1 | 6/2011 | Raccah |
| 2011/0147334 | A1 | 6/2011 | Mettu et al. |
| 2011/0174759 | A1 | 7/2011 | Titherington |
| 2012/0085725 | A1 | 4/2012 | Parekh et al. |
| 2012/0138561 | A1 | 6/2012 | Brozell |
| 2012/0152882 | A1 | 6/2012 | Tune |
| 2015/0122767 | A1 | 5/2015 | Mettu et al. |
| 2016/0257462 | A1 | 9/2016 | Baughman et al. |
| 2016/0288965 | A1 | 10/2016 | Yeager et al. |
| 2017/0043918 | A1 | 2/2017 | Guo |
| 2018/0028762 | A1 | 2/2018 | Maxfield |
| 2018/0044073 | A1 | 2/2018 | Dong et al. |

* cited by examiner

DISENGAGED

SAFETY CAP

CROSS-REFERENCE TO RELATED APPLICATION

This application is a divisional application of copending U.S. patent application Ser. No. 16/027,210, filed Jul. 3, 2018, and entitled "SAFETY CAP." The entire contents of the above application is hereby incorporated by reference and made a part of this specification. Any and all priority claims identified in the Application Data Sheet, or any correction thereto, are hereby incorporated by reference under 37 CFR § 1.57.

BACKGROUND

Field

Features for safety caps are described. More specifically, features for multi-piece, child-resistant safety caps.

Description of the Related Art

Child-resistant caps are used on containers that store potentially dangerous substances or substances not suitable for children. Such caps seek to provide for safer or authorized opening of the container. Child-resistant caps seek to prevent the containers from being opened easily by a young child who may have less strength and/or manual dexterity to open a closure.

SUMMARY

The embodiments disclosed herein each have several aspects no single one of which is solely responsible for the disclosure's desirable attributes. Without limiting the scope of this disclosure, its more prominent features will not be briefly discussed. After considering this discussion, and particularly after reading the section entitled "Detailed Description," one will understand how the features of the embodiments described herein provide advantages over existing systems, devices, and methods.

The following disclosure describes non-limiting examples of some embodiments. For instance, other embodiments of the disclosed systems and methods may or may not include the features described herein. Moreover, disclosed advantages and benefits can apply only to certain embodiments of the invention and should not be used to limit the disclosure.

Systems and devices for safety caps are described.

In one aspect described herein, a multi-piece, child resistant safety cap configured for releasable securement to a container that has an opening and a thread, the cap comprises an insert having a top, a sidewall, and an opening configured to receive at least a portion of the container so as to engage the thread when rotated about a longitudinal axis of the insert, the top including at least one upwardly projecting protrusion defining a lock surface and an unlock surface; and a casing comprising a top, a sidewall, and an opening forming a receptacle therein, the receptacle being sized and shaped to nest the insert therein while allowing the casing to slide in an axial direction around the insert between an engaged position and a disengaged position, the top of the casing having at least one downwardly projecting fin defining a lock surface and an unlock surface, the lock surface of the downwardly projecting fin contacting the lock surface of the upwardly projecting protrusion to enable transfer of a clockwise rotational force from the casing and to the insert when the casing is in the engaged position without having to maintain a force on the casing in the axial direction towards the insert, the unlock surface of the downwardly projecting fin contacting the unlock surface of the upwardly projecting protrusion to enable transfer of a counter-clockwise rotational force from the casing and to the insert when the casing is in the engaged position if the force is maintained and biasing the casing to move from the engaged position to the disengaged position if the force is not maintained.

In some embodiments, at least one of the at least one downwardly projecting fin and the at least one upwardly projecting protrusion is slanted to impart a separation force between the insert and the casing when the casing is in the engaged position and rotated about the longitudinal axis in the counter-clockwise direction. In some embodiments, a magnitude of the force is at least as great as a magnitude of the separation force to rotate the insert with the casing in the counter-clockwise direction.

In some embodiments, a line normal to at least one of the unlock surface of the at least one downwardly projecting fin and the unlock surface of the at least one upwardly projecting protrusion is nonparallel to the axial direction.

In some embodiments, a line normal to at least one of the lock surface of the at least one downwardly projecting fin and the lock surface of the at least one upwardly projecting protrusion is parallel to the axial direction.

In some embodiments, an angle of the lock surface of the at least one downwardly projecting fin and a complementary angle of the lock surface of the at least one upwardly projecting protrusion are selected so as to prevent a magnitude of a separation force between the insert and the casing that would move the casing from the engaged position to the disengaged position when the casing is rotated about the longitudinal axis in the clockwise direction.

In some embodiments, at least one of the unlock surface of the at least one downwardly projecting fin and the unlock surface of the at least one upwardly projecting protrusion is sloped relative to a plane perpendicular to the longitudinal axis.

In some embodiments, the engaged position comprises a range of discrete positions of the casing relative to the insert along the longitudinal axis.

In some embodiments, the at least one upwardly projecting protrusion of the insert comprises a triangular cross-sectional shape in a plane perpendicular to the longitudinal axis. In some embodiments, the lock surface of the insert is adjacent to the unlock surface of the insert. In some embodiments, the triangular cross-sectional shape varies along the longitudinal axis.

In some embodiments, the at least one upwardly projecting protrusion comprises a distal surface, and a gap is formed between the distal surface and the top of the casing when the casing is in the engaged position.

In some embodiments, the at least one upwardly projecting protrusion comprises a distal surface, and a gap is formed between the distal surface and the at least one fin when the casing is in the disengaged position so as to allow the cap to freely spin relative to the insert.

In some embodiments, an outer surface of the sidewall of the insert comprises at least one groove parallel to the longitudinal axis.

In some embodiments, the insert comprises an outwardly extending flange disposed near the opening, and the receptacle of the casing comprises a circumferential groove sized and shaped to receive the flange and limit travel of the casing relative to the insert to a band defined by the engaged position and the disengaged position.

In some embodiments, the insert comprises an outwardly extending flange disposed near the opening, and the receptacle of the casing comprises a circumferential groove sized and shaped to receive the flange and inhibit the insert from being removed from the casing.

In some embodiments, the insert comprises an outwardly extending flange disposed near the opening and having a shoulder, and the receptacle of the casing comprises a circumferential groove sized and shaped to receive the flange and contact the shoulder when the casing is in the engaged position.

In some embodiments, the insert comprises an outwardly extending flange disposed near the opening, and the receptacle of the casing comprises a lip projecting inward towards the longitudinal axis and contacting the flange when the casing is in the disengaged position.

In some embodiments, the insert comprises a thread configured to engage with the thread of the container.

In some embodiments, the container is a cartridge for a vape pen.

In some embodiments, the container is a pharmacy container.

In one aspect described herein, a multi-piece, child resistant safety cap configured for releasable securement to a container that has an opening and a thread, the cap comprises an insert having a top, a sidewall, and an opening configured to receive at least a portion of the container so as to engage the thread when rotated about a longitudinal axis of the insert, the top including at least one protrusion defining a lock surface and an unlock surface, a horizontal line projecting along the unlock surface of the at least one protrusion does not pass through the longitudinal axis; and a casing comprising a top, a sidewall, and an opening forming a receptacle therein, the receptacle being sized and shaped to nest the insert therein, the top of the casing having at least one fin defining a lock surface and an unlock surface, the lock surface of the at least one fin contacting the lock surface of the at least one protrusion to enable transfer of a clockwise rotational force from the casing and to the insert when the casing is in an engaged position, the unlock surface of the at least one fin contacting the unlock surface of the at least one protrusion to enable transfer of a counter-clockwise rotational force from the casing and to the insert when the casing is in the engaged position.

In one aspect described herein, a method of manufacturing a multi-piece, child resistant safety cap configured for releasable securement to a container that has an opening and a thread, the method comprises providing an insert having a top, a sidewall, and an opening configured to receive at least a portion of the container so as to engage the thread when rotated about a longitudinal axis of the insert, the top including at least one upwardly projecting protrusion defining a lock surface and an unlock surface; providing a casing comprising a top, a sidewall, and an opening forming a receptacle therein, the top of the casing having at least one downwardly projecting fin defining a lock surface and an unlock surface; and assembling the insert with the casing so that the casing can slide in an axial direction along the insert, the lock surface of the downwardly projecting fin selectively contacts the lock surface of the upwardly projecting protrusion to enable transfer of a clockwise rotational force from the casing and to the insert, and the unlock surface of the downwardly projecting fin selectively contacts the unlock surface of the upwardly projecting protrusion to enable transfer of a counter-clockwise rotational force from the casing and to the insert.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the drawing, can be arranged, substituted, combined, and designed in a wide variety of different configurations, all of which are explicitly contemplated and make part of this disclosure.

DETAILED DESCRIPTION

The following detailed description is directed to certain specific embodiments of the invention. However, the invention can be embodied in a multitude of different ways. It should be apparent that the aspects herein may be embodied in a wide variety of forms and that any specific structure, function, or both being disclosed herein is merely representative of one or more embodiments of the invention. An aspect disclosed herein may be implemented independently of any other aspects and that two or more of these aspects may be combined in various ways. For example, a device (e.g., the illustrated embodiments of a safety cap) may be implemented, or a method may be practiced, using any number of the aspects set forth herein. In addition, such an device may be implemented or such a method may be practiced using other structure, functionality, or structure and functionality in addition to, or other than one or more of the aspects set forth herein.

The description of the disclosed implementations is provided to enable any person skilled in the art to make or use the present disclosure. Various modifications to these implementations will be readily apparent to those skilled in the art, and the generic principles defined herein may be applied to other implementations without departing from the spirit or scope of the disclosure. Thus, the present disclosure is not intended to be limited to the implementations shown herein but is to be accorded the widest scope consistent with the principles and novel features disclosed herein.

Figure 1:
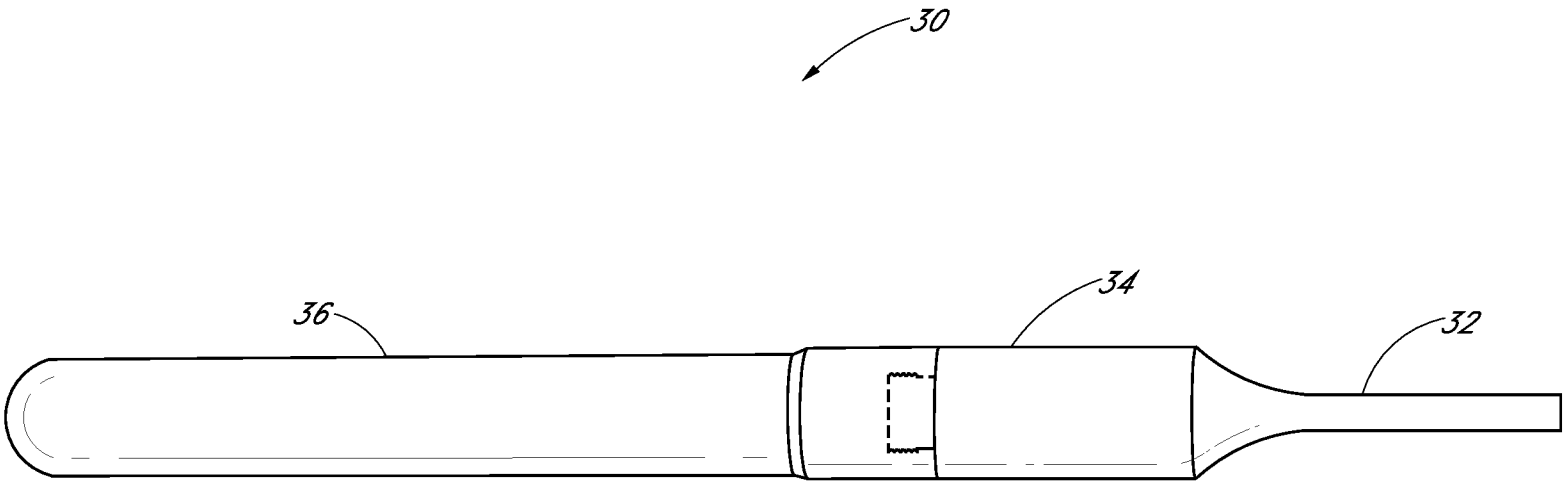
FIG. 1 is a side view of an embodiment of a vape pen assembly that includes a mouthpiece, a cartridge, and a battery secured end to end.

FIG. 1 is a side view of a vape pen 30. The vape pen is a handheld electronic device that heats a liquid to generate a vapor. The vape pen 30 may include a mouthpiece 32, a cartridge 34, and a battery 36. In certain embodiments, the mouthpiece 32, the cartridge 34, and the battery 36 are secured end to end. The cartridge 34 may hold the liquid to be heated by the battery 36. The liquid may include nicotine, tobacco, marijuana, *Cannabis*, flavoring, and/or medicine. The user inhales the heated vapor through the mouthpiece 32. The vape pen 30 may use replaceable cartridges 34. A user may remove the cartridge 34 from the vape pen 30 for storage purposes or to replace the removed cartridge 34 with the same cartridge 34 or a different cartridge 34.

Figure 2:
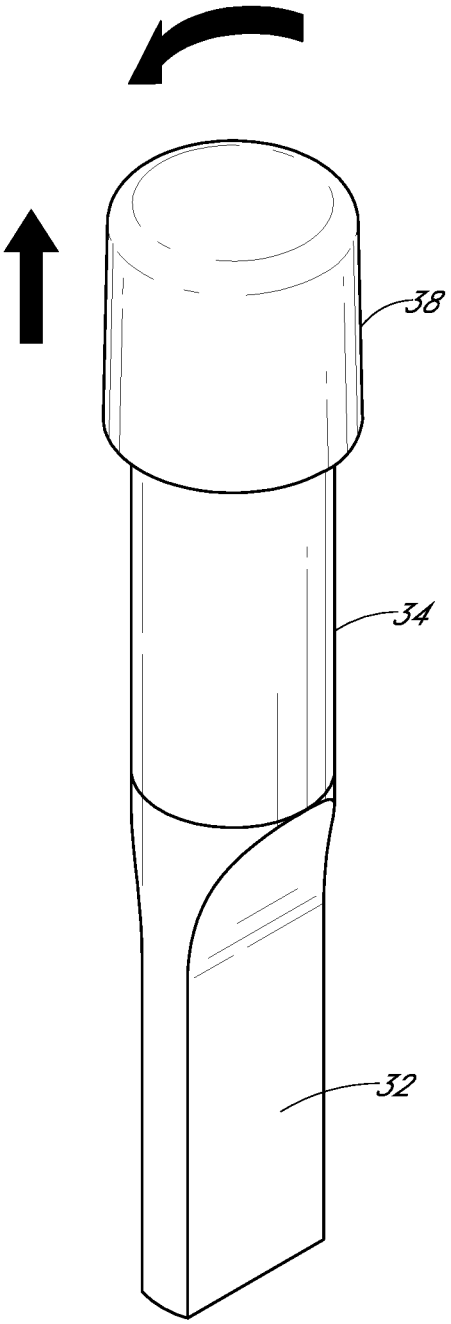
FIG. 2 is a perspective view of the vape pen from FIG. 1 with the battery replaced with an embodiment of a safety cap. The safety cap is removed from the cartridge by rotating the safety cap in a direction of the arrow while pushing down on the safety cap.

FIG. 2 is a perspective view of the vape pen 30 with the battery 36 replaced with an embodiment of a safety cap 38. The safety cap 38 is removed from the cartridge 34 by rotating the safety cap 38 in a direction of the arrow while pushing down on the safety cap 38.

Figure 3:
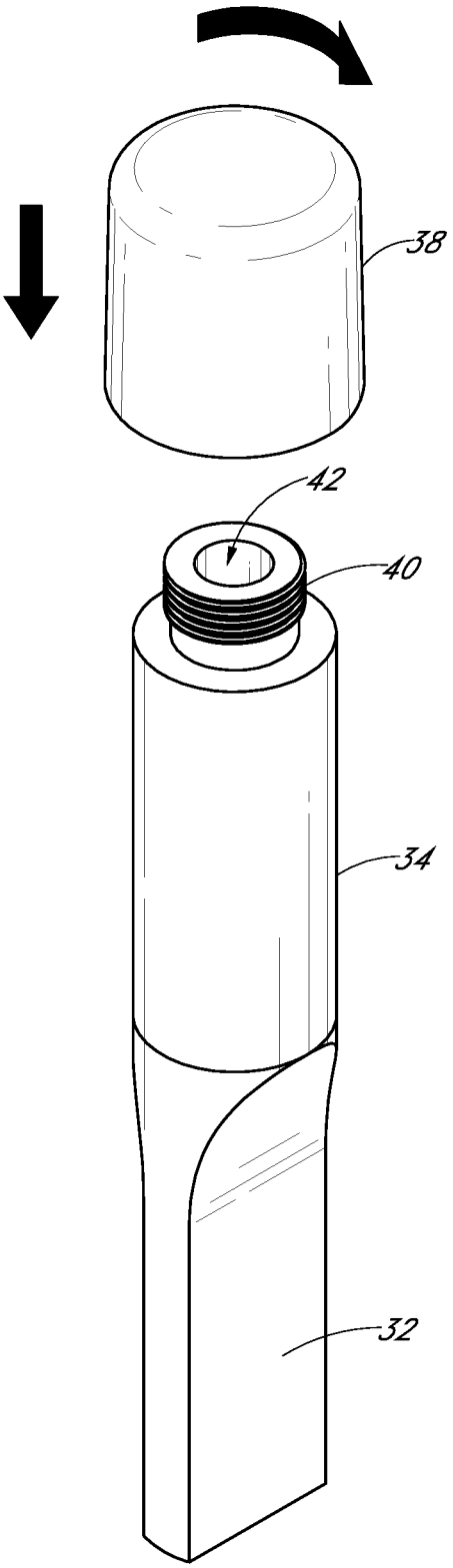
FIG. 3 is a perspective view similar to FIG. 2 with the safety cap removed from the cartridge. The safety cap can be attached to the cartridge by rotating the safety cap in a direction of the arrow.

FIG. 3 is a perspective view similar to FIG. 2 with the safety cap 38 removed from the cartridge 34. The safety cap 38 can be attached to the cartridge 34 by rotating the safety cap 38 in a direction of the arrow. As shown in FIG. 3, the cartridge 34 may have an opening 42 and a thread 40. The safety cap 38 engages the thread 40 of the cartridge 34 to close the opening 42. The safety cap 38 may prevent liquid from escaping through the opening 42 of the cartridge 34 when the cap 38 is in the closed position. The cap 38 may be removed by pressing downwards in the axial direction and rotating the cap 38 in the counter-clockwise direction. The cap 38 may close by rotating the cap 38 in the clockwise direction. The cap 38 may be designed to be child resistant, such that it is difficult for a young child to remove the cap 38 and open the cartridge 34.

Figure 4:
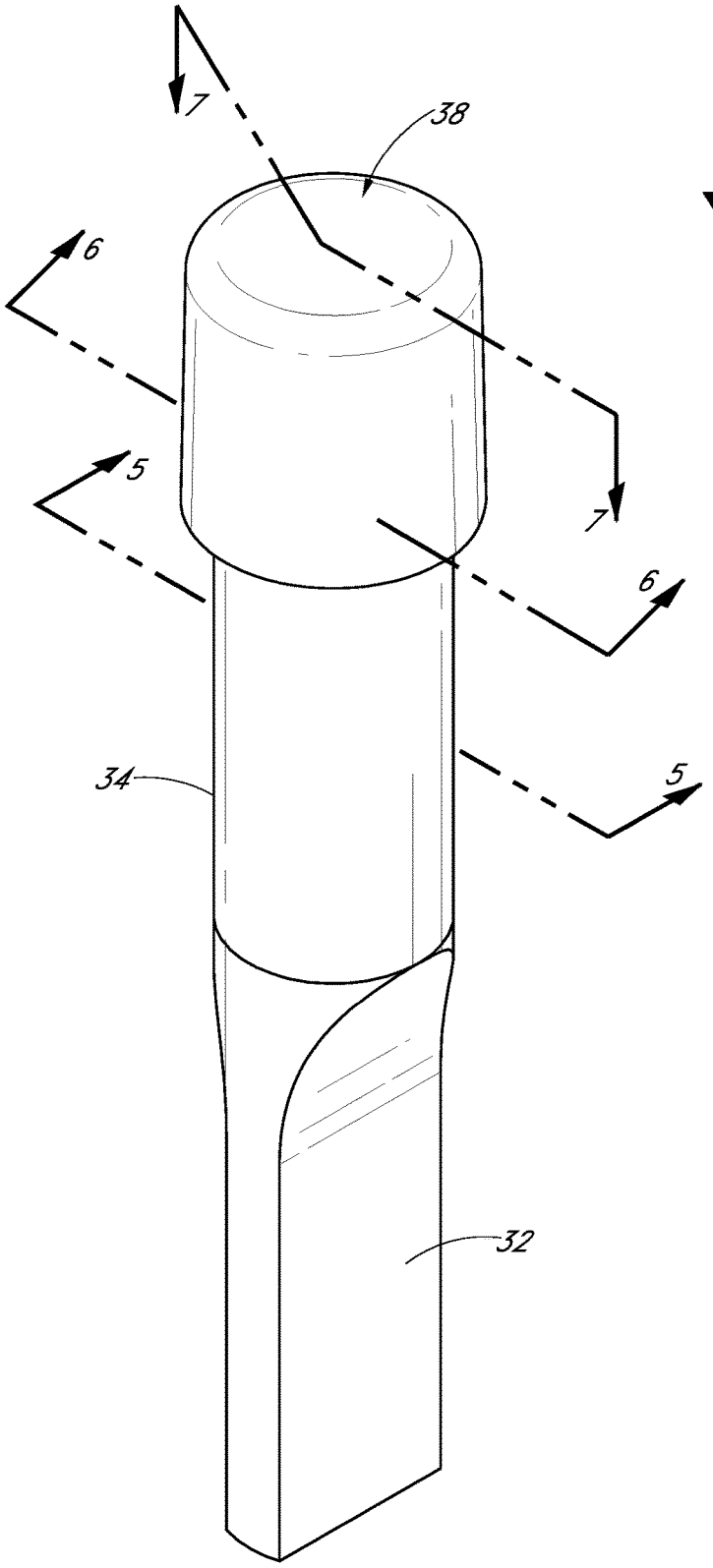
FIG. 4 is a perspective view similar to FIG. 2.
Figure 5A:
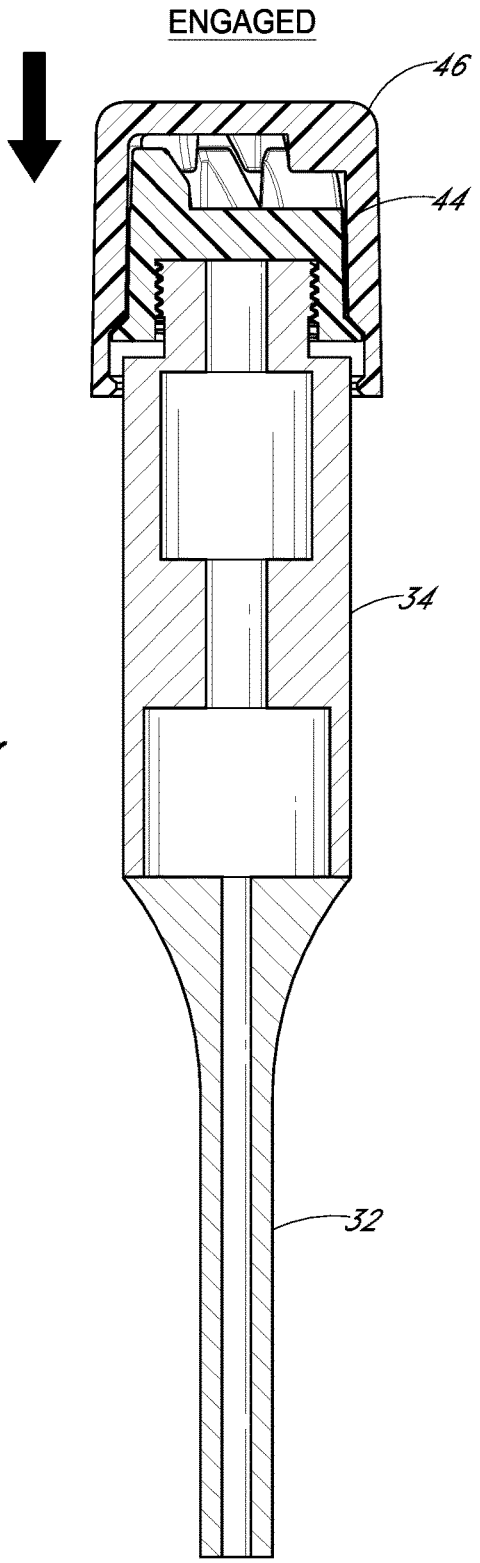
FIG. 5A is a cross-section view of the safety cap, the cartridge, and the mouthpiece of FIG. 4 taken along line 5-5 and showing an insert and a casing of the safety cap engaged with one another.
Figure 11:
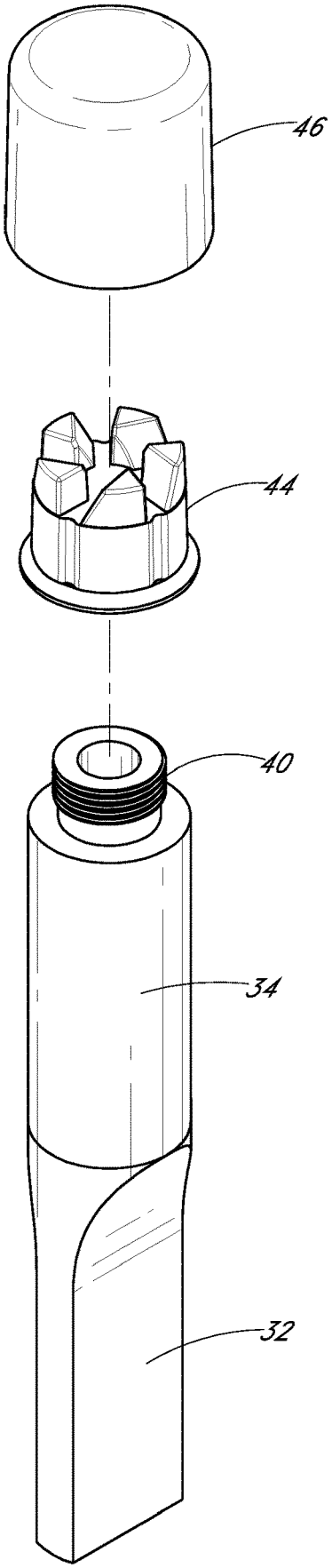
FIG. 11 is a view similar to FIG. 3 except that the insert is shown removed from the casing.

FIG. 4 is a perspective view similar to FIG. 2. FIG. 5A is a cross-section view of the safety cap 38, the cartridge 34, and the mouthpiece 32 of FIG. 4 taken along line 5-5. The safety cap 38 may include one or more nested inner and outer members. For example, the embodiment of the safety cap 38 illustrated in FIG. 5A includes an insert 44 nested in a casing 46. FIG. 11 shows an exploded view with the insert 44 removed from the casing 46.

Figure 5B:
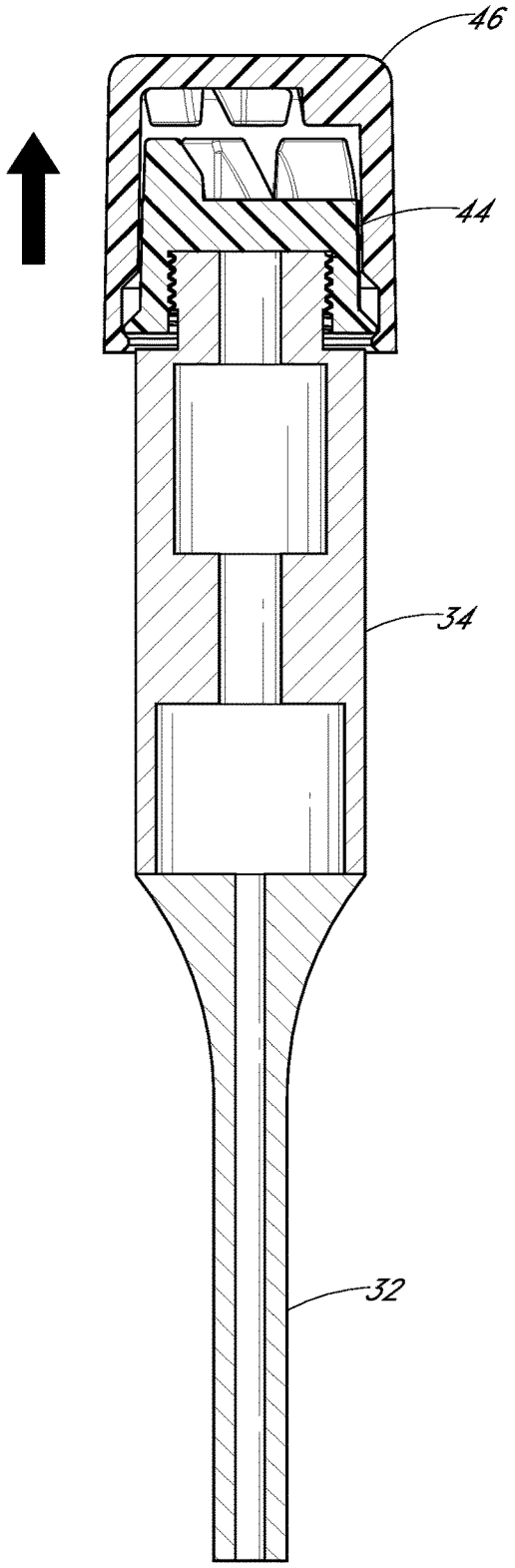
FIG. 5B is a cross-section view similar to FIG. 5A except the casing has been moved in a direction of the arrow so as to disengage from the insert.

In FIG. 5A, the insert 44 is engaged with the casing 46. FIG. 5B is a cross-section view similar to FIG. 5A except the casing 46 has been moved in a direction of the arrow so as to disengage from the insert 44. Thus, the insert 44 and the casing 46 in FIG. 5A are in an engaged position, whereas in FIG. 5B the insert 44 and the casing 46 are in a disengaged position. The casing 46 is able to move up and down (as oriented in FIGS. 5A and 5B) in the axial direction to move between the engaged and disengaged positions. FIGS. 12-17 show various views of the casing 46. FIGS. 18-23 show various views of the insert 44.

Figures 6A, 6B, 6C:
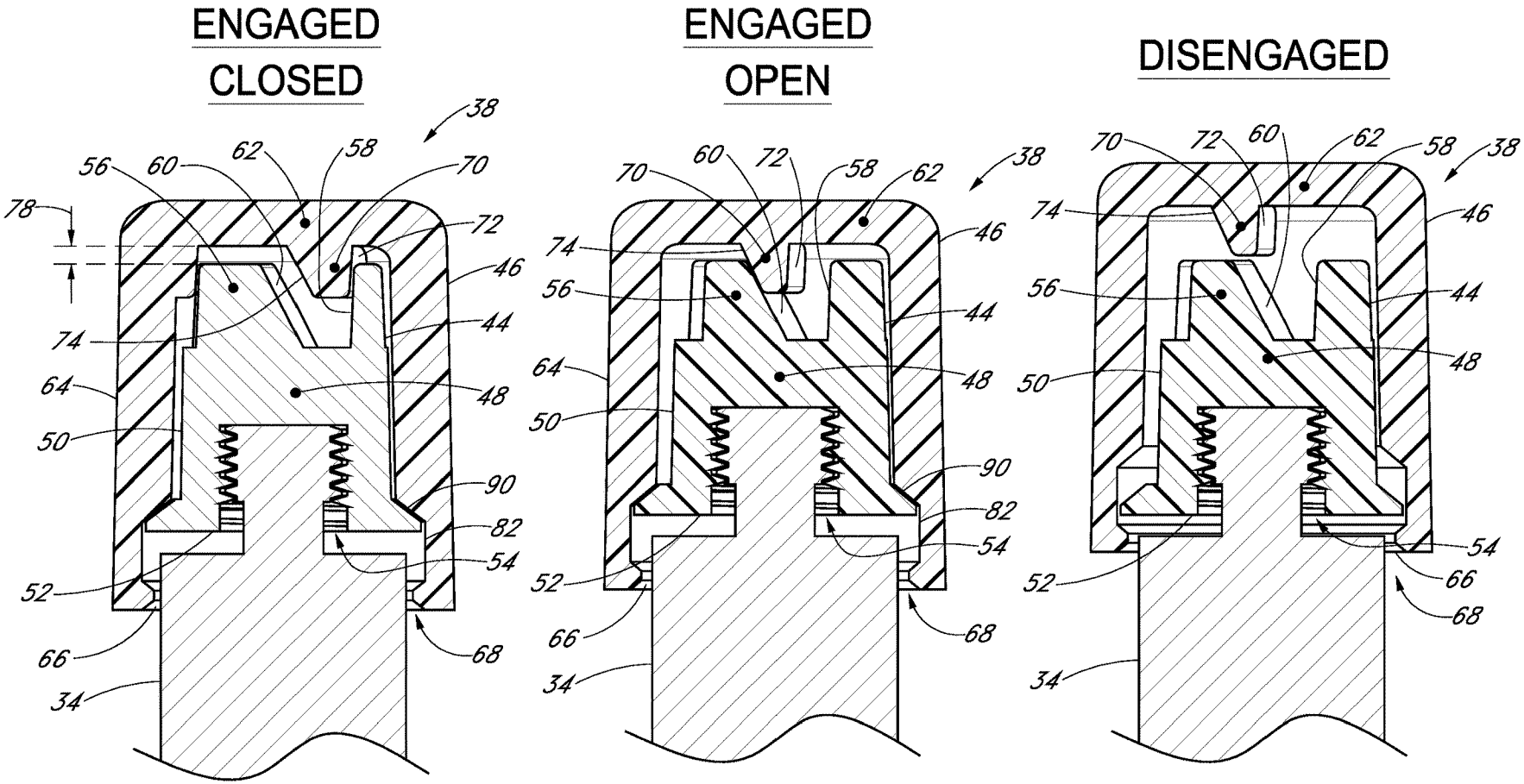
FIG. 6A is a partial cross-section view of the safety cap and the cartridge from FIG. 4 taken along line 6-6 and showing the casing engaged with the insert so as to allow clockwise rotation of the casing to close the safety cap on the cartridge.
FIG. 6B is a partial cross-section view similar to FIG. 6A except that the casing has been rotated in a counter clockwise direction from its position illustrated in FIG. 6A to engage with the insert so as to allow removal of the safety cap to open the cartridge.
FIG. 6C is a partial cross-section view similar to FIG. 6B except that the casing has been further rotated in the counterclockwise direction from its position illustrated in FIG. 6B without concurrently applying a sufficient force in an axial direction to maintain engagement with the insert resulting in the casing moving in the opposite axial direction away from the insert.

FIG. 6A is a partial cross-section view of the safety cap 38 and the cartridge 34 from FIG. 4 taken along line 6-6 and showing the casing 46 engaged with the insert 44 so as to allow clockwise rotation of the casing 46 to close the safety cap 38 on the cartridge 34. FIG. 6B is a partial cross-section view similar to FIG. 6A except that the casing 46 has been rotated in a counter clockwise direction from its position illustrated in FIG. 6A to engage with the insert 44 so as to allow removal of the safety cap 38 to open the cartridge 34. FIG. 6C is a partial cross-section view similar to FIG. 6B except that the casing 46 has been further rotated in the counterclockwise direction from its position illustrated in FIG. 6B without concurrently applying a sufficient force in an axial direction to maintain engagement with the insert 44 resulting in the casing 46 moving in the opposite axial direction away from the insert 44. As shown in FIGS. 6A-6C, the casing 46 may have a top 62, a sidewall 64, at least one fin 70, and an opening 66 forming a receptacle 68 therein. The receptacle 54 of the casing 46 may be sized and shaped to nest the insert 44 therein while allowing the casing 46 to slide in an axial direction along a longitudinal axis of the insert 44 between the engaged position and the disengaged position. The casing 46 may be moved in the axial direction away from the insert 44 when moved from the engaged position to the disengaged position. In the disengaged position, the casing 46 may freely rotate about the longitudinal axis.

Figure 7B:
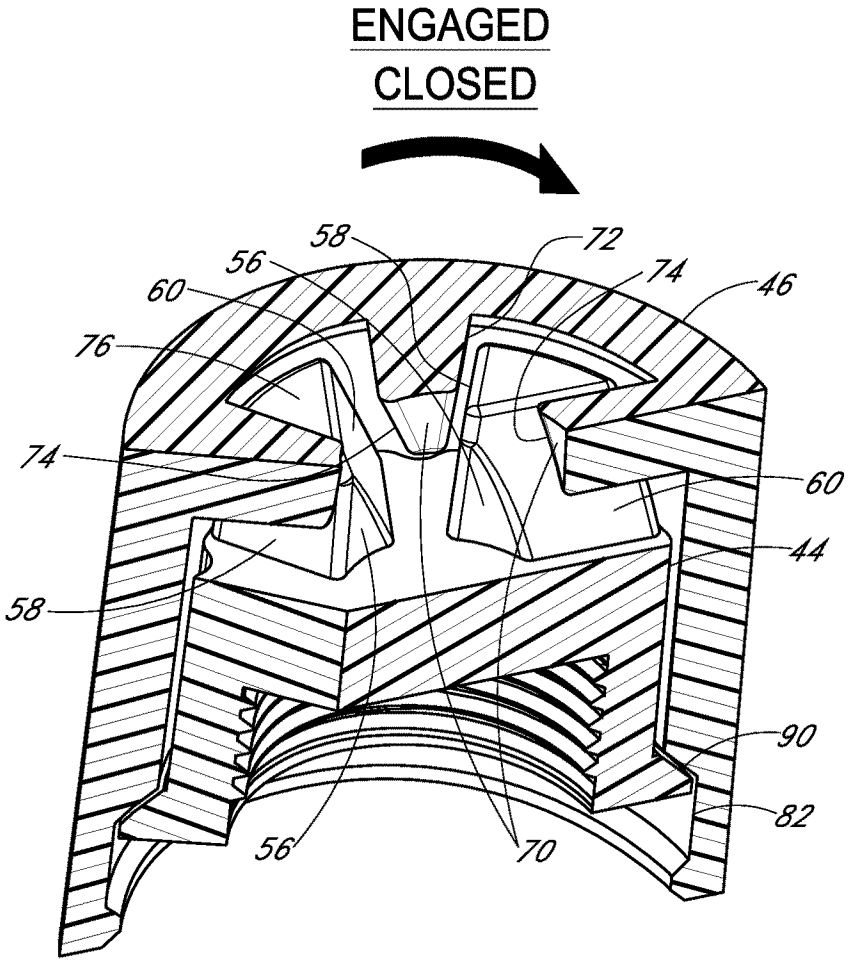
FIG. 7B is a cross-section view similar to FIG. 7A except that the casing has been rotated in the clockwise direction to engage with the insert.
Figure 7A:
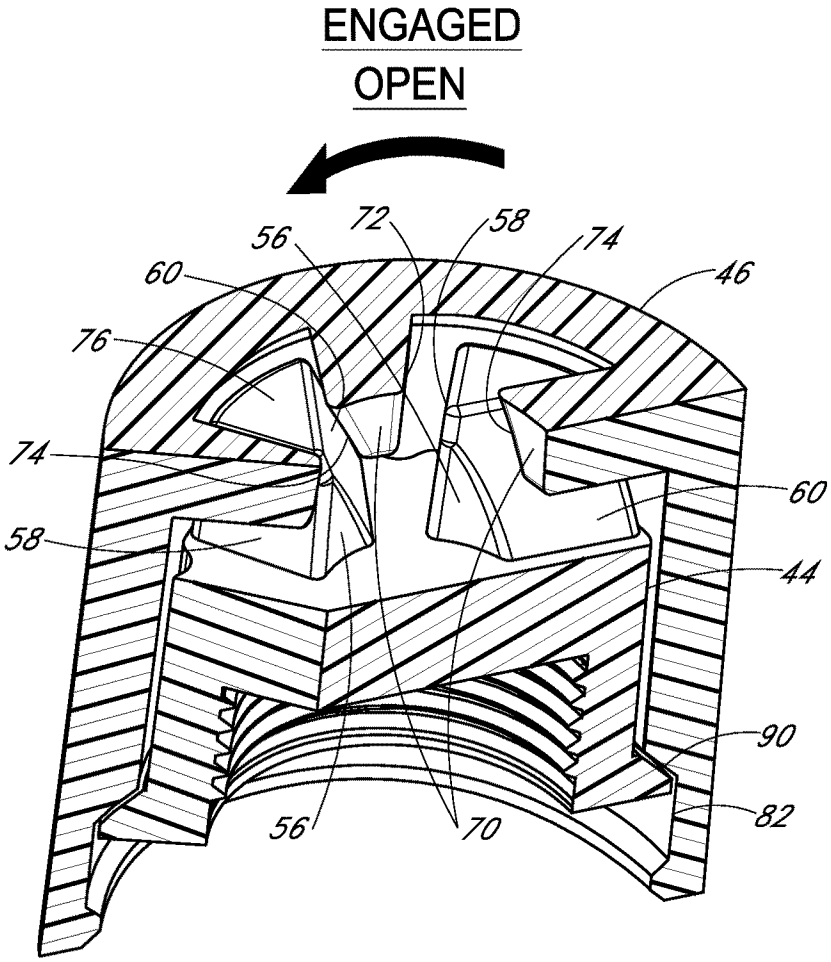
FIG. 7A is a cross-section view of the safety cap from FIG. 4 taken along line 7-7 showing the casing rotated in the counter clockwise direction to engage with the insert.
Figure 9:
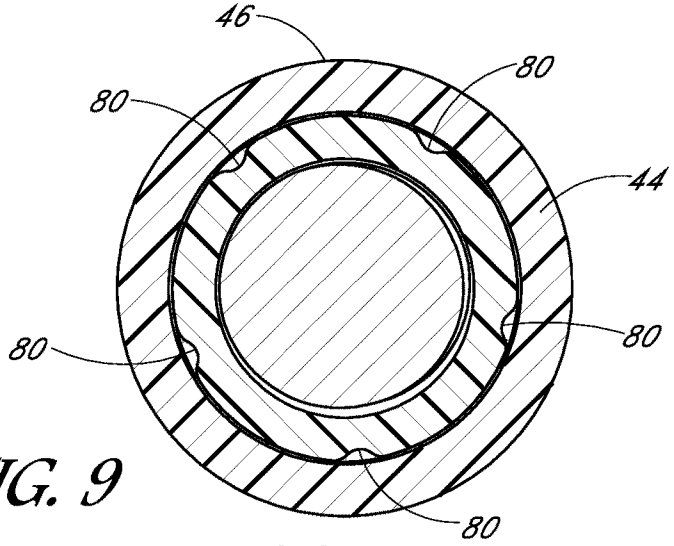
FIG. 9 is a cross-section view of the safety cap of FIG. 8 taken along line 9-9.
Figure 8:
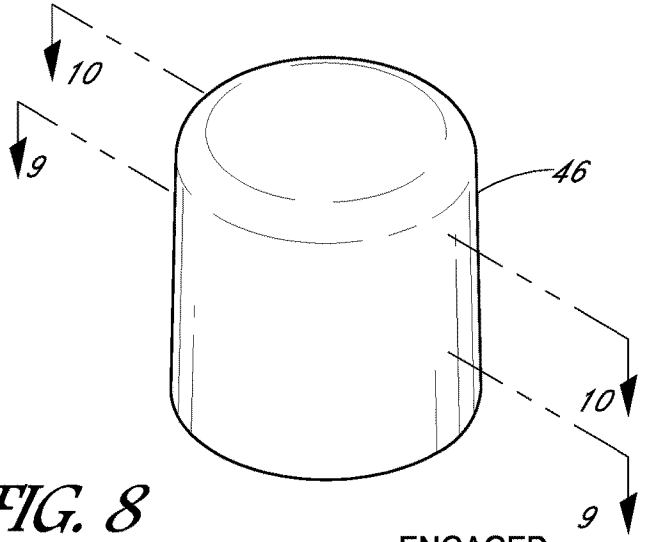
FIG. 8 is a perspective view of the safety cap of FIG. 2.

FIG. 7A is a cross-section view of the safety cap 38 from FIG. 4 taken along line 7-7 showing the casing 46 rotated in the counter clockwise direction to engage with the insert 44. FIG. 7B is a cross-section view similar to FIG. 7A except that the casing 46 has been rotated in the clockwise direction to engage with the insert 44. As shown in FIGS. 6A-7B, the top 62 of the casing 46 has at least one fin 70 defining a lock surface 72 and an unlock surface 74. In certain embodiments, the at least one fin 70 projects in a downward direction.

Figure 15:
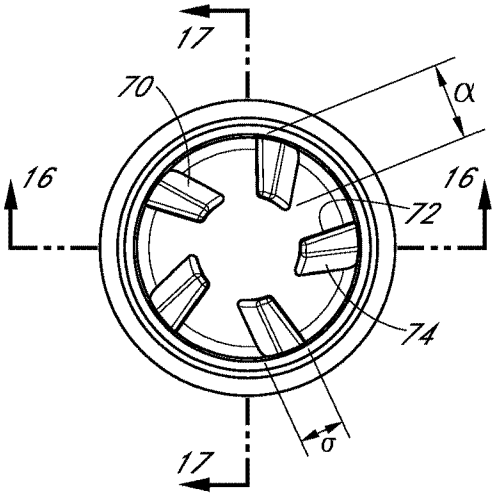
FIG. 15 is a bottom view of the casing from FIG. 12.

As shown in FIG. 15, in certain embodiments, the casing 46 has five fins 70 equally sized and spaced around the circumference of the receptacle 68 of the casing 46. In certain embodiments, each fin 70 has a lock surface 72 and an unlock surface 74.

Figure 15A:
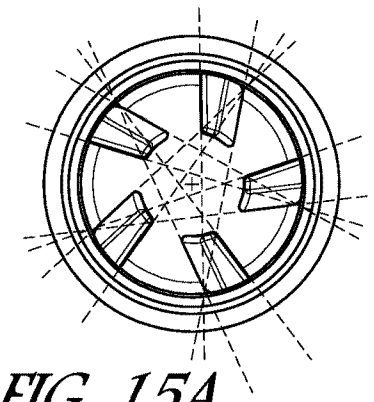
FIG. 15A is a view similar to FIG. 15 except projection lines have been added.
Figure 12:
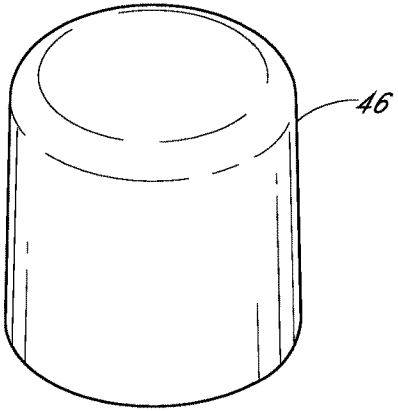
FIG. 12 is a perspective view of the casing of the safety cap of FIG. 11.
Figure 13:
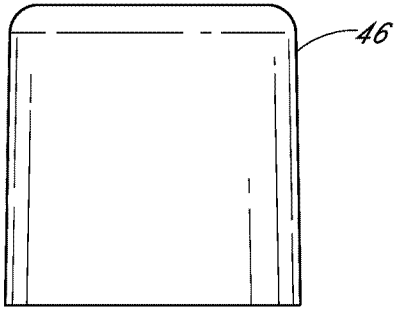
FIG. 13 is a side view of the casing of FIG. 12.
Figure 14:
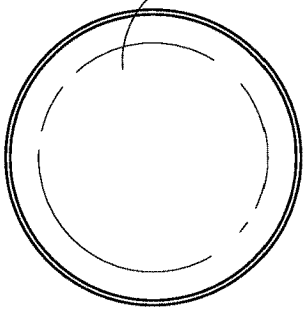
FIG. 14 is a top view of the casing from FIG. 12.

As shown in FIG. 15, the at least one fin 70 may generally extend from an edge 94 or inner wall of the receptacle 68 towards a center of the casing 46. In some embodiments, the at least one fin 70 extends from the edge 94 to the center of the casing 46. In some embodiments, the at least one fin 70 extends only partially from the edge 94 towards the center of the casing 46. As is illustrated in FIG. 15A, in some embodiments, a line projecting along the lock surface 72 of the at least one fin 70 and away from the edge 94 passes near to the center of casing 46. In some embodiments, the line projecting along the lock surface 72 of the at least one fin 70 and away from the edge 94 passes through the center of casing 46.

As is illustrated in FIG. 15A, in some embodiments, a line projecting along the unlock surface 74 of the at least one fin 70 and away from the edge 94 passes near to the center of casing 46. In some embodiments, the line projecting along the unlock surface 74 of the at least one fin 70 and away from the edge 94 passes through the center of casing 46. Arranging the at least one fin 70 to have lines projecting along the lock surface 72 and unlock surface 74 that do not pass through the center of the casing 46 may allow the lock surface 72 and the unlock surface 74 to have greater surface areas when engaging the lock surface 58 and the unlock surface 60 of the at least one protrusion 56 of the insert 44.

As shown in FIG. 15, in certain embodiments, the at least one fin 70 has a maximum length $\alpha$ as measured from the edge 94. In some embodiments, the maximum length $\alpha$ may be between 3 mm and 6 mm. In some embodiments, the maximum length $\alpha$ may be between 4 mm and 5 mm. In some embodiments, the maximum length $\alpha$ may be between 4.7 mm and 4.9 mm. In some embodiments, the maximum length $\alpha$ may be less than 5 mm. In some embodiments, the maximum length $\alpha$ may be more than 5 mm.

As shown in FIG. 15, in certain embodiments, the at least one fin 70 has a maximum width $\sigma$. In some embodiments, the width $\sigma$ is greater than 1.8 mm. In some embodiments, the width $\sigma$ is greater than or equal to 1.84 mm. In some embodiments, the width $\sigma$ is between 1.83 mm and 2 mm. In some embodiments, the casing 46 may have more or less than five fins 70. In some embodiments, the at least one fin 70 may be evenly spaced around the circumference of the receptacle 68 of the casing 46. In some embodiments, there may be irregular spacing between at least two of the at least one fin 70. In some embodiments, two or more of the at least one fin 70 may be equally sized. In some embodiments, two or more of the at least one fin 70 may have different sizes. In some embodiments, the casing 46 may have a single fin 70.

Figure 16:
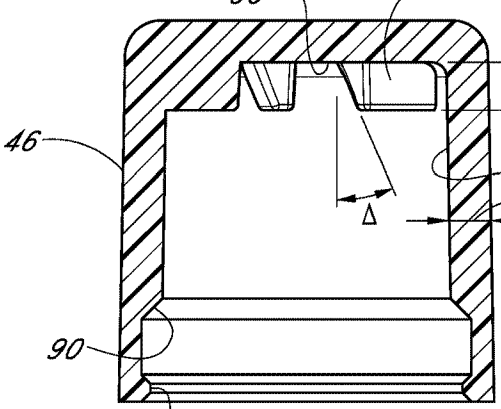
FIG. 16 is a cross-section view of the casing from FIG. 15 taken along line 16-16
Figure 17:
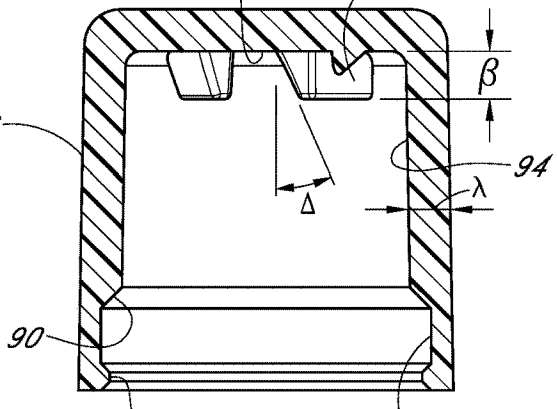
FIG. 17 is a cross-section view of the casing from FIG. 15 taken along line 17-17.

As shown in FIGS. 16 and 17, in certain embodiments, the at least one fin 70 extends from the top 96 of casing 46 to a height $\beta$. In some embodiments, height $\beta$ of the at least one fin 70 may be between 2.0 mm and 2.5 mm. In some embodiments, the height $\beta$ of the at least one fin 70 may be between 2.27 mm and 2.29 mm. The height $\beta$ of the at least one fin 70 provides sufficient grip for engagement with the at least one protrusion 56, without elongating the overall height of the safety cap 38. As shown in FIGS. 16 and 17, the casing 46 may have a wall thickness $\lambda$. In some embodiments, the wall thickness $\lambda$ is between 1.20 mm and 1.35 mm. In some embodiments, the wall thickness $\lambda$ is between 1.26 mm and 1.28 mm or any other value.

Figure 19:
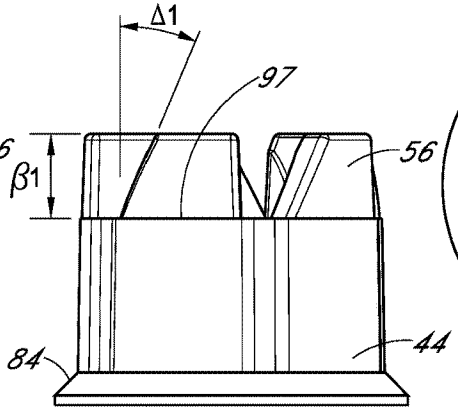
FIG. 19 is a side view of the insert of FIG. 18.
Figure 18:
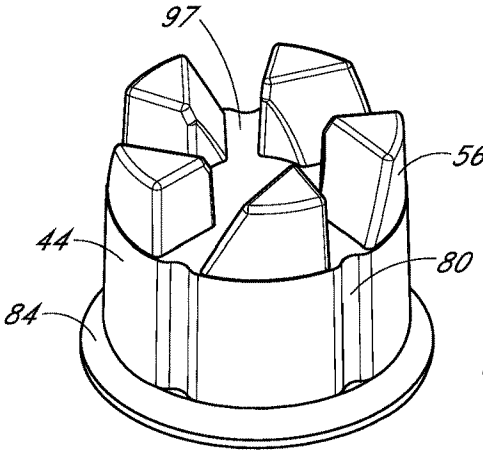
FIG. 18 is a perspective view of the insert of the safety cap of FIG. 11.

In some embodiments, an angle of the lock surface 72 of the at least one fin 70 and the complementary angle of the lock surface 58 of the at least one protrusion 56 are selected so as to prevent a magnitude of a separation force between the insert 44 and the casing 46 that would move the casing 46 from the engaged position to the disengaged position when the casing 46 is rotated about the longitudinal axis in the clockwise direction. In some embodiments, the unlock surface 74 of the at least one fin 70 and the unlock surface 60 of the at least one protrusion 56 are sloped relative to a plane perpendicular to the longitudinal axis. As shown in FIGS. 16 and 17, the at least one fin 70 may extend from the top 96 of casing 46 at an angle $\Delta$ relative to the longitudinal axis. In some embodiments, angle $\Delta$ may be between 10° and 30°. In some embodiments, angle $\Delta$ may be between 15° and 21°. In some embodiments, angle $\Delta$ may be between 17° and 19°. As shown in FIG. 19, the at least one protrusion 56 of the insert 44 may extend from the upper surface 97 of the insert 44 at an angle $\Delta$1 relative to the longitudinal axis. In some embodiments, the angle $\Delta$1 may be between 10° and 30°. In some embodiments, the angle $\Delta$1 may be between 15° and 21°. In some embodiments, the angle $\Delta$1 may be between 17° and 19°. In some embodiments, the angle $\Delta$ and the angle $\Delta$1 are selected to be complementary.

Returning to FIGS. 6A-7B, the insert 44 may have a top 48, a sidewall 50, an opening 52, a receptacle 54, and at least one protrusion 56. The opening 52 of the insert 44 is configured to receive at least a portion of the cartridge 34 so as to engage the thread 40 when rotated about a longitudinal axis of the insert 44. In some embodiments, the insert 44 may include a thread 86 configured to engage with the thread 40 of the cartridge 38. The top 48 of the insert 44 includes the at least one protrusion 56 defining a lock surface 58 and an unlock surface 60. In certain embodiments, the at least one protrusion 56 projects in an upward direction.

Figure 23A:
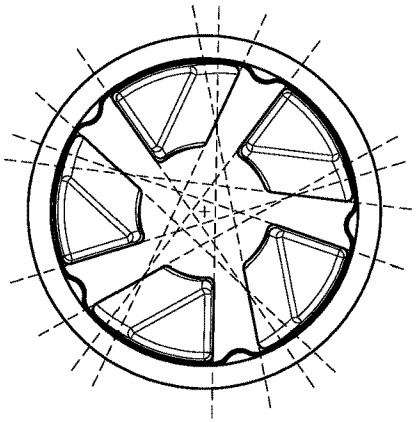
FIG. 23A is a view similar to FIG. 23 except projection lines have been added.
Figure 20:
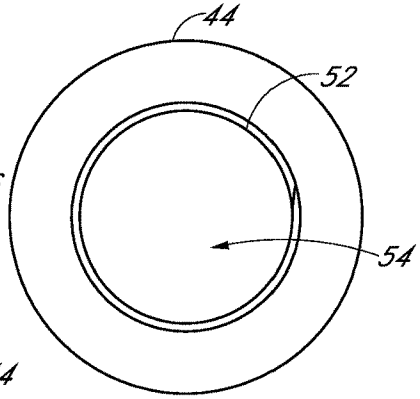
FIG. 20 is bottom view of the insert from FIG. 18.
Figure 23:
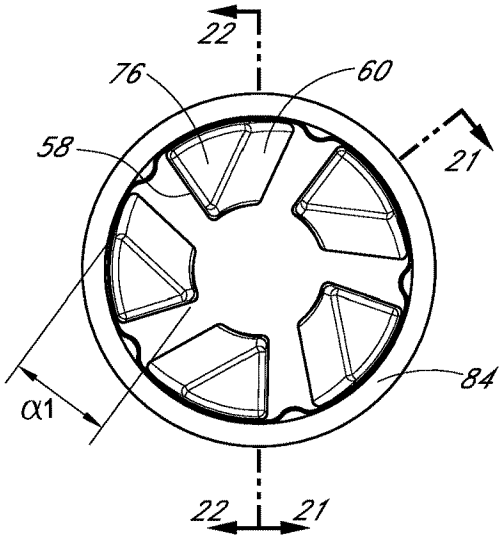
FIG. 23 is a top view of the insert from FIG. 18.

As shown in FIG. 23, the at least one protrusion 56 may generally extend from an edge 95 or outer wall of the insert 44 towards a center of the insert 44. In some embodiments, the at least one protrusion 56 extends from the edge 95 to the center of the insert 44. In some embodiments, the at least one protrusion 56 extends only partially from the edge 95 towards the center of the insert 44. As is illustrated in FIG. 23A, in some embodiments, a line projecting along the lock surface 58 of the at least one protrusion 56 and away from the edge 95 passes near to the center of insert 44. In some embodiments, the line projecting along the lock surface 58 of the at least one protrusion 56 and away from the edge 95 passes through the center of insert 44.

As is illustrated in FIG. 23A, in some embodiments, a line projecting along the unlock surface 60 of the at least one protrusion 56 and away from the edge 95 passes near to the center of insert 44. In some embodiments, the line projecting along the unlock surface 60 of the at least one protrusion 56 and away from the edge 95 passes through the center of insert 44. Arranging the at least one protrusion 56 to have lines projecting along the lock surface 58 and unlock surface 60 that do not pass through the center of the insert 44 may allow the lock surface 58 and the unlock surface 60 to have greater surface areas when engaging the lock surface 72 and the unlock surface 74 of the at least one fin 70 of the casing 46.

As shown in FIG. 23, the at least one protrusion 56 may have a maximum width $\alpha 1$. In some embodiments, the maximum width $\alpha 1$ is between 2 mm and 5 mm. In some embodiments, the maximum width $\alpha 1$ is between 2.5 mm and 3.5 mm. In some embodiments, the maximum width $\alpha 1$ is greater than or equal to 3.0 mm. In some embodiments, the maximum width $\alpha 1$ is between 3.0 mm and 3.1 mm. As shown in FIG. 23, the insert 44 may have five protrusions 56 equally sized and spaced around the circumference of the top 48 of the insert 44, each protrusion 56 having a lock surface 58 and an unlock surface 60. In some embodiments, the insert 44 may have more or less than five protrusions 56. In some embodiments, the at least one protrusion 56 may be evenly spaced around the circumference of the top 48 of the insert 44. In some embodiments, there may be irregular spacing between at least two protrusions 56. In some embodiments, two or more of the protrusions 56 may be equally sized. In some embodiments, two or more of the protrusions 56 may be differently sized. In some embodiments, the insert 44 may have a single protrusion 56.

Figure 22:
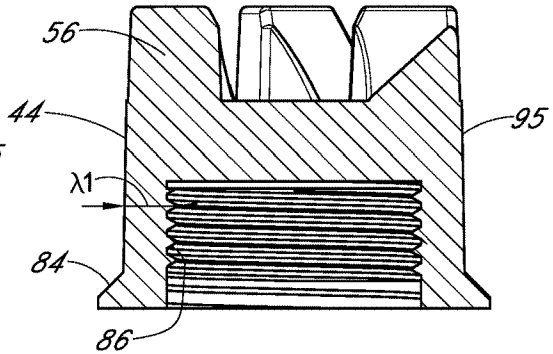
FIG. 22 is a cross-section view of the insert from FIG. 23 taken along line 22-22
Figure 21:
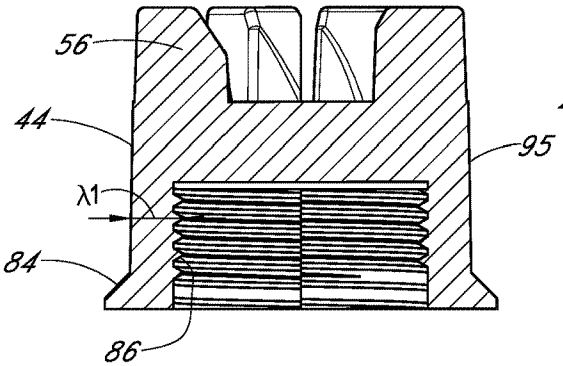
FIG. 21 is a cross-section view of the insert from FIG. 23 taken along line 21-21.

As shown in FIG. 19, the at least one protrusion 56 may extend from the upper surface 97 of the insert 44 to a height $\beta 1$. In some embodiments, the height $\beta 1$ of the at least one protrusion 56 may be between 2.0 mm and 3.0 mm. In some embodiments, the height $\beta 1$ of the at least one protrusion 56 may be between 2.5 mm and 3.0 mm. In some embodiments, the height $\beta 1$ of the at least one protrusion 56 may be between 2.7 mm and 2.9 mm. The height $\beta 1$ of the at least one protrusion 56 provides sufficient grip for engagement with the at least one fin 70, without elongating the height of the safety cap 38. As shown in FIGS. 21 and 22, the insert 44 may have a wall thickness $\lambda 1$. In some embodiments, the wall thickness $\lambda 1$ may be between 1.20 mm and 1.35 mm. In some embodiments, the wall thickness $\lambda 1$ may be between 1.26 mm and 1.28 mm or any other value.

Figure 10B:
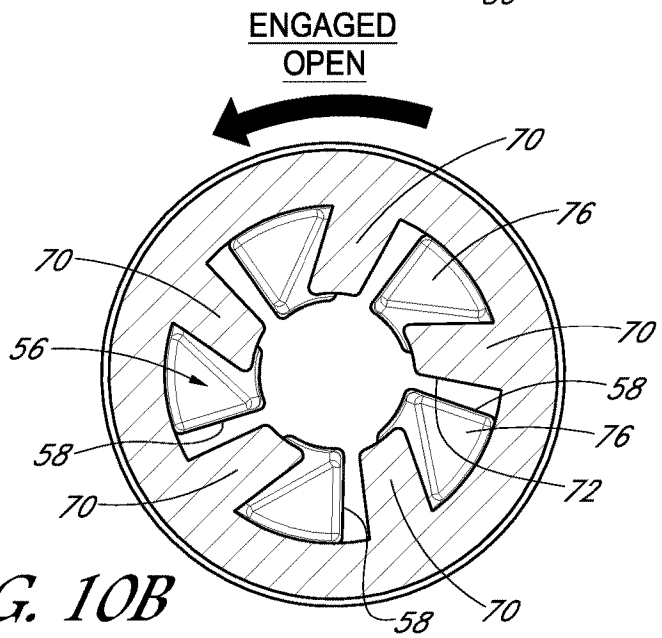
FIG. 10B is a cross-section view of the safety cap similar to FIG. 10A except that the casing has been rotated in the counterclockwise direction to engage with the insert so as to rotate the insert toward an open position.
Figure 10A:
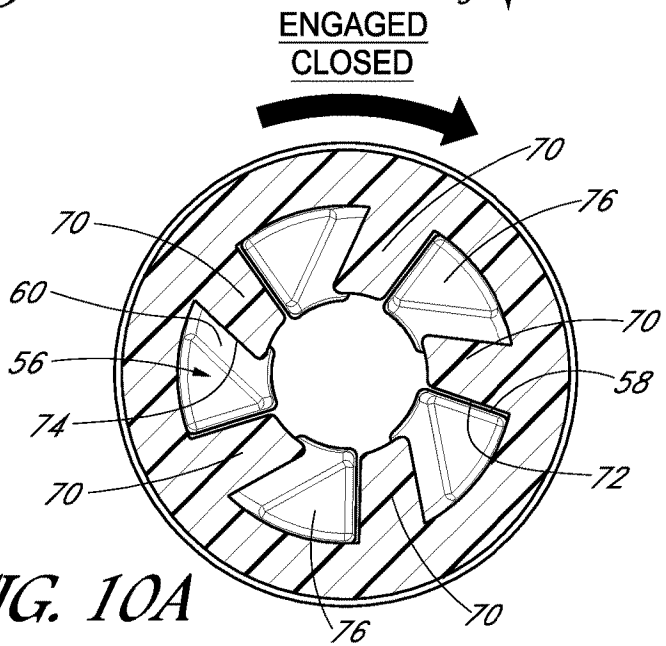
FIG. 10A is a cross-section view of the safety cap of FIG. 8 taken along line 10-10 where the casing is engaged with the insert to rotate the insert toward a closed position.

Returning to FIGS. 6A and 6B, the casing 46 is shown in the engaged position. As shown in FIGS. 6A, 7B, and 10A the lock surface 72 of the at least one fin 70 may contact the lock surface 58 of the at least one protrusion 56 to enable transfer of a clockwise rotational force from the casing 46 to the insert 44 without having to maintain a force on the casing 46 in the axial direction towards the insert 44. As shown in FIGS. 6B, 7A, and 10B the unlock surface 74 of the at least one fin 70 may contact the unlock surface 60 of the at least one protrusion 56 of the insert 44 to enable transfer of a counter-clockwise rotational force from the casing 46 to the insert 44 when a force on the casing 46 in the axial direction towards the insert 44 is maintained. In certain embodiments, the casing 46 may be biased to move from the engaged position to the disengaged position if the force on the casing 46 in the axial direction towards the insert 44 is not maintained.

Returning to FIGS. 7A and 7B, the at least one protrusion 56 of the insert 44 may include a distal surface 76. A gap 78 may be formed between the distal surface 76 of the insert 44 and the top 62 of the casing 46 when the casing 46 is in the engaged position, as shown in FIG. 6A. In some embodiments, a gap is formed between the distal surface 76 of the insert 44 and the at least one fin 70 of the casing 46 when the casing 46 is in the disengaged position so as to allow the cap 38 to freely spin relative to the insert 44, as shown in FIG. 6C. In some embodiments, the engaged position includes a range of discrete positions of the casing 46 relative to the insert 44 along the longitudinal axis.

As shown in FIGS. 7A and 10B, the at least one fin 70 of the casing 46 and the at least one protrusion 56 of the insert 44 may be slanted to impart a separation force between the insert 44 and the casing 46 when the casing 46 is in the engaged position and rotated about the longitudinal axis in the counter-clockwise direction. A magnitude of the force is at least as great as a magnitude of the separation force to rotate the insert 44 with the casing 46 in the counter-clockwise direction.

In some embodiments, a line along at least one of the unlock surface 74 of the at least one fin 70 and the unlock surface 60 of the at least one protrusion 56 is nonparallel to the axial direction. In some embodiments, the line along the at least one of the lock surface 72 of the at least one fin 70 and the lock surface 58 of the at least one protrusion 56 is parallel to the axial direction.

In some embodiments, the at least one protrusion 56 of the insert 44 has a triangular cross-sectional shape in a plane perpendicular to the longitudinal axis, as shown in FIGS. 10A-B. In some embodiments, the triangular cross-sectional shape of the at least one protrusion 56 varies along the longitudinal axis. In some embodiments, the lock surface 58 of the insert 44 is adjacent to the unlock surface 60 of the insert 44.

In some embodiments, an outer surface of the sidewall 50 of the insert 44 includes at least one groove 80. In some embodiments, the groove 80 is parallel to the longitudinal axis, as shown in FIG. 23. As shown in FIG. 23, the insert 44 may have five longitudinal grooves 80 evenly spaced around the circumference of the sidewall 50. In some embodiments, the insert 44 may have less than five grooves 80. In some embodiments, the insert 44 may have more than five grooves 80. In some embodiments, the grooves 80 may be evenly spaced around the circumference of the sidewall 50 of the insert 44. In some embodiments, there may be irregular spacing between at least two grooves 80. In some embodiments, the insert 44 may have a single groove 80.

In some embodiments, the insert 44 includes an outwardly extending flange 84 disposed near the opening 52 of the insert 44, as shown in FIG. 19. As shown in FIG. 23, the flange 84 may extend circumferentially around the insert 44. In some embodiments, the flange 84 may extend continuously around the circumference of the insert 44. In some embodiments, the flange 84 may extend partially around the circumference of the insert 44. In some embodiments, the flange 84 may include sections that each extend partially around the circumference of the insert 44.

As shown in FIG. 17, the casing 46 may include a circumferential groove 82. The circumferential groove 82 of the casing 46 may be sized and shaped to receive the flange 84 of the insert 44 and limit travel of the casing 46 relative to the insert 44. In certain embodiments, the travel of the casing 46 is limited to a band defined by the engaged position and the disengaged position. The band is a length measured in the axial direction. In some embodiments, the circumferential groove 82 is sized and shaped to receive the flange 84 of the insert 44 and inhibit the insert 44 from being removed from the casing 46. In some embodiments, the circumferential groove 82 is sized and shaped to receive the flange 44 and the flange 44 contacts the shoulder 90 when the casing 46 is in the engaged position, as shown in FIGS. 6A and 6B. In some embodiments, the receptacle 68 of the casing 46 includes a lip 92 projecting inward towards the longitudinal axis and contacting the flange 44 when the casing 46 is in the disengaged position.

Figure 24:
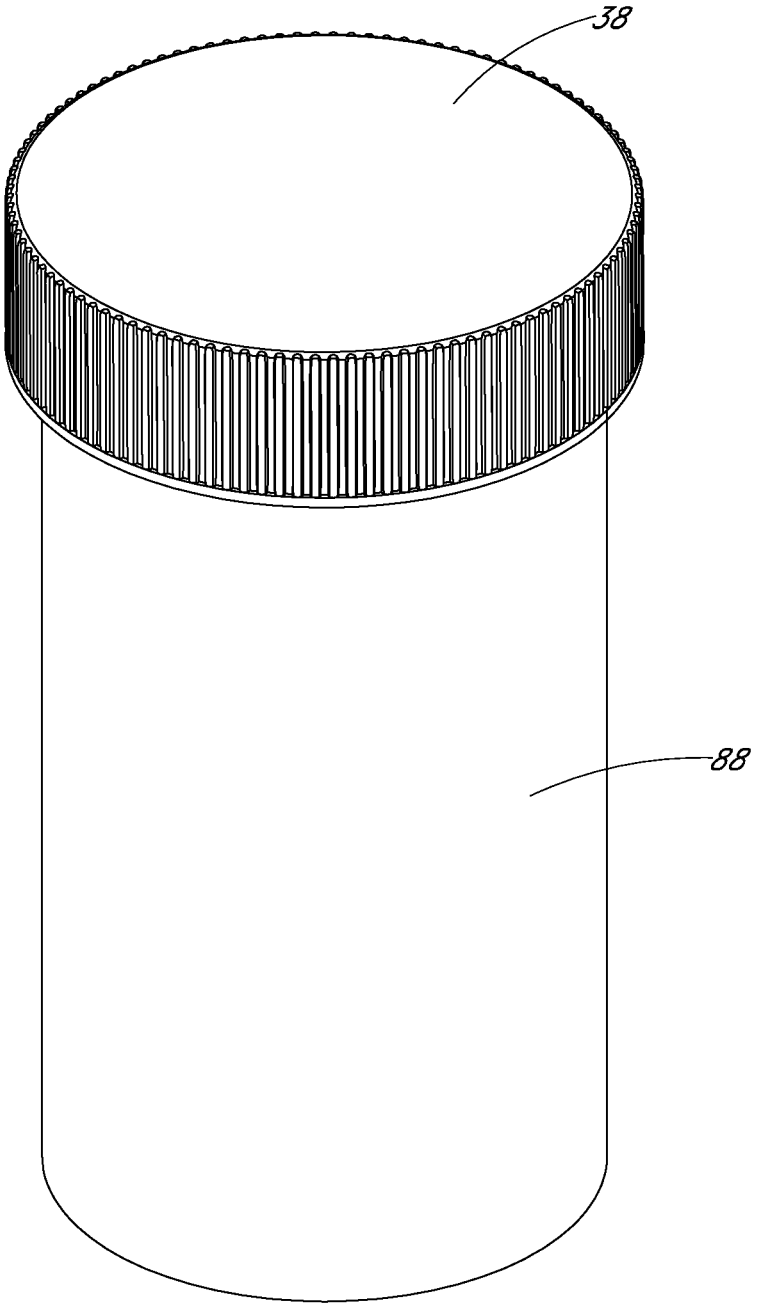
FIG. 24 is a perspective view of an embodiment of the safety cap from FIG. 8 sized and shaped for use on a pharmacy container.

In some embodiments, the safety cap 38 may be used for any container, for example, a cartridge or tank for a vape pen or electronic cigarette, a cylindrical container, a pharmacy container, a food product container, a drink product container, etc. As shown in FIG. 24, an embodiment of the safety cap 38 is sized and shaped for use with a pharmacy container 88.

In some embodiments, the casing 46 is made of plastic, such as acrylonitrile butadiene styrene (ABS), metal, composite, or other suitable material. In some embodiments, the insert 44 is made of plastic, such as acrylonitrile butadiene styrene (ABS), metal, composite, or other suitable material.

The foregoing description details certain embodiments of the devices and methods disclosed herein. It will be appreciated, however, that no matter how detailed the foregoing appears in text, the devices and methods can be practiced in many ways. It should be noted that the use of particular terminology when describing certain features or aspects of the invention should not be taken to imply that the terminology is being re-defined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A method of manufacturing a multi-piece, child resistant safety cap configured for releasable securement to a container that has an opening and a thread, the method comprising:

providing an insert having a top, a sidewall, and an opening configured to receive at least a portion of the container so as to engage the thread when rotated about a longitudinal axis of the insert, the top including at least one upwardly projecting protrusion defining a lock surface and an unlock surface;

providing a casing comprising a top, a sidewall, and an opening forming a receptacle therein, the top of the casing having at least one downwardly projecting fin defining a lock surface and an unlock surface; and assembling the insert with the casing so that the casing can slide in an axial direction along the insert, the lock surface of the downwardly projecting fin selectively contacts the lock surface of the upwardly projecting protrusion to enable transfer of a clockwise rotational force from the casing and to the insert when the casing is in an engaged position, and the unlock surface of the downwardly projecting fin selectively contacts the unlock surface of the upwardly projecting protrusion to enable transfer of a counter-clockwise rotational force from the casing and to the insert that is sufficient to rotate the insert.

2. The method of claim 1, wherein at least one of the at least one downwardly projecting fin and the at least one upwardly projecting protrusion is slanted to impart a separation force between the insert and the casing when the casing is in the engaged position and rotated about the longitudinal axis in the counter-clockwise direction.

3. The method of claim 2, wherein a magnitude of the force is at least as great as a magnitude of the separation force to rotate the insert with the casing in the counter-clockwise direction.

4. The method of claim 1, wherein a line normal to at least one of the unlock surface of the at least one downwardly projecting fin and the unlock surface of the at least one upwardly projecting protrusion is nonparallel to the axial direction.

5. The method of claim 1, wherein a line normal to at least one of the lock surface of the at least one downwardly projecting fin and the lock surface of the at least one upwardly projecting protrusion is parallel to the axial direction.

6. The method of claim 1, wherein an angle of the lock surface of the at least one downwardly projecting fin and a complementary angle of the lock surface of the at least one upwardly projecting protrusion are selected so as to prevent a magnitude of a separation force between the insert and the casing that would move the casing from the engaged position to the disengaged position when the casing is rotated about the longitudinal axis in the clockwise direction.

7. The method of claim 1, wherein at least one of the unlock surface of the at least one downwardly projecting fin and the unlock surface of the at least one upwardly projecting protrusion is sloped relative to a plane perpendicular to the longitudinal axis.

8. The method of claim 1, wherein the engaged position comprises a range of discrete positions of the casing relative to the insert along the longitudinal axis.

9. A method of manufacturing a multi-piece, child resistant safety cap configured for releasable securement to a container that has an opening and a thread, the method comprising:

providing an insert having a top, a sidewall, and an opening configured to receive at least a portion of the container so as to engage the thread when rotated about a longitudinal axis of the insert, the top including at least one protrusion defining a lock surface and an unlock surface, a horizontal line projecting along the unlock surface of the at least one protrusion does not pass through the longitudinal axis;

providing a casing comprising a top, a sidewall, and an opening forming a receptacle therein, the top of the casing having at least one fin defining a lock surface and an unlock surface; and nesting the insert within the receptacle so that the lock surface of the at least one fin contacts the lock surface of the at least one protrusion to enable transfer of a clockwise rotational force from the casing and to the insert when the casing is in an engaged position, the unlock surface of the at least one fin contacting the unlock surface of the at least one protrusion to enable transfer of a counter-clockwise rotational force from the casing and to the insert when the casing is in the engaged position that is sufficient to rotate the insert.

10. The method of claim 9, wherein the at least one protrusion of the insert comprises a triangular cross-sectional shape in a plane perpendicular to the longitudinal axis.

11. The method of claim 10, wherein the lock surface of the insert is adjacent to the unlock surface of the insert.

12. The method of claim 10, wherein the triangular cross-sectional shape varies along the longitudinal axis.

13. The method of claim 9, wherein the at least one protrusion comprises a distal surface, and wherein a gap is formed between the distal surface and the top of the casing when the casing is in the engaged position.

14. The method of claim 9, wherein the at least one protrusion comprises a distal surface, and wherein a gap is formed between the distal surface and the at least one fin when the casing is in the disengaged position so as to allow the cap to freely spin relative to the insert.

15. The method of claim 9, wherein an outer surface of the sidewall of the insert comprises at least one groove parallel to the longitudinal axis.

16. A method of manufacturing a safety cap configured for releasable securement to a container that has an opening and a thread, the method comprising:

providing an insert having a top, a sidewall, and an opening, the insert being configured to engage the thread when in contact with the insert and rotated about a longitudinal axis of the insert, the top including at least one protrusion defining a lock surface and an unlock surface;

providing a casing having a top, a sidewall, and an opening forming a receptacle therein, the top of the casing having at least one fin defining a lock surface and an unlock surface; and assembling the insert within the receptacle so that the lock surface of the at least one fin contacts the lock surface of the at least one protrusion to enable transfer of a clockwise rotational force from the casing and to the insert when the casing is in an engaged position, the unlock surface of the at least one fin contacting the unlock surface of the at least one protrusion to enable transfer of a counter-clockwise rotational force from the casing and to the insert when the casing is in the engaged position that is sufficient to rotate the insert.

17. The method of claim 16, wherein the insert comprises an outwardly extending flange disposed near the opening, and wherein the receptacle of the casing comprises a circumferential groove sized and shaped to receive the flange and limit travel of the casing relative to the insert to a band defined by the engaged position and the disengaged position.

18. The method of claim 16, wherein the insert comprises an outwardly extending flange disposed near the opening, and wherein the receptacle of the casing comprises a circumferential groove sized and shaped to receive the flange and inhibit the insert from being removed from the casing.

19. The method of claim 16, wherein the insert comprises an outwardly extending flange disposed near the opening and having a shoulder, and wherein the receptacle of the casing comprises a circumferential groove sized and shaped to receive the flange and contact the shoulder when the casing is in the engaged position.

20. The method of claim 16, wherein the insert comprises an outwardly extending flange disposed near the opening, and wherein the receptacle of the casing comprises a lip projecting inward towards the longitudinal axis and contacting the flange when the casing is in the disengaged position.

* * * * *